United States Patent [19]

Nitzberg

[11] Patent Number: 4,522,448

[45] **Date of Patent: * Jun. 11, 1985**

[54] METHOD AND APPARATUS FOR RECLAMATION BY REDUCING HIGHWALLS TO GRADABLE RUBBLE AT AUGERED OR LONGWALLED MINING SITES

[76] Inventor: Leonard R. Nitzberg, 1413 Buckeye La., Knoxville, Tenn. 37919

[ * ] Notice: The portion of the term of this patent subsequent to Jan. 13, 1999 has been disclaimed.

[21] Appl. No.: 224,294

[22] Filed: Jan. 12, 1981

Related U.S. Application Data

[63] Continuation-in-part of Ser. No. 64,558, Aug. 8, 1979, Pat. No. 4,244,624.

[51] Int. Cl.[3] ..... E21C 41/00

[52] U.S. Cl. ..... 299/13; 102/324; 102/312

[58] Field of Search ..... 299/13; 102/311, 312; 405/258

[56] References Cited

U.S. PATENT DOCUMENTS

| | | | |
|---|---|---|---|
| 2,239,123 | 4/1941 | Stoneking | 102/312 |
| 4,183,584 | 1/1980 | St. Peter | 299/13 |
| 4,244,624 | 1/1981 | Nitzberg | 299/13 |

*Primary Examiner*—Ernest R. Purser

*Attorney, Agent, or Firm*—Pitts, Ruderman & Kesterson

[57] ABSTRACT

A method of reducing a highwall or sharp cliff like exposure at a mining site to gradable rubble for the purpose of reclamation is disclosed. The method includes the steps of placing a series of non-directional explosive charges at specific preselected locations on the floor of cavities created by mining, such cavities being auger holes, longwall mine areas or the like. The charges are then detonated within the cavities to create rubble. Preferably, each cavity is sealed proximate its opening on the highwall with stemming to maintain pressure within the associated cavity during the blast and to alternate the expulsion of air blast emissions. The charges are detonated to attenuate the horizontal force vectors, and to enhance the vertical force vectors such that the major effect of the blasts is exerted on the overburden to assure breakage. An improved charge for carrying out the method of the present invention is also disclosed.

15 Claims, 21 Drawing Figures

METHOD AND APPARATUS FOR RECLAMATION BY REDUCING HIGHWALLS TO GRADABLE RUBBLE AT AUGERED OR LONGWALLED MINING SITES

This application is a continuation-in-part of copending Ser. No. 064,558 filed Aug. 8, 1979, now U.S. Pat. No. 4,244,624 and entitled "Method for Reclaiming Highwalls at Mining Sites With Partially Mined Ore Veins".

This invention relates to the creation of rubble at mining sites using non-directional, unconfined, individual charges placed in confined sub-surface cavities created by ore removal proximate a highwall.

Present statutes governing the mining industry forbid the mining of coal, even in previously mined areas, unless all highwalls at the mining site are eliminated subsequent to the mining operation. At many reworkable steep slope sites in the mountainous regions of the eastern and western United States, sufficient spoil cannot be produced in the surface mining operation to cover highwalls. Additionally, the spoil shortages are general and widespread and cannot be alleviated by the creation of "bar" or "borrow" pits which are pits dug for the production of spoil. Further, creation of spoil from a zone above the highwall by conventional techniques is expensive and often economically impractical. As a result, much of the coal reserves in steep slope areas are unminable under controlling regulations and laws.

OBJECTS OF THE INVENTION

Accordingly, it is the object of the present invention to produce a method of creating gradable rubble from highwalls at mining sites, particularly steep slope areas. It is also an object of the present invention to detonate charges positioned at preselected locations in the cavity(s) such that the horizontal force vectors are attenuated and the vertical vectors required to be exerted on the overburden are enhanced. Another object of the invention is to provide a self-stemming blasting technique. Yet another object of the invention is to provide a blasting method which utilizes a low intensity blasting media which produces less lateral brisance and thereby lower adverse seismic effects. A further object of the present invention is to provide methods for producing rubble which are cost effective. Still another object of the invention is to provide charges for carrying out the method of the present invention which are assembled from low cost explosives which are suitable for loading techniques employed in the present reclamation method.

SUMMARY OF THE INVENTION

Figure 1:
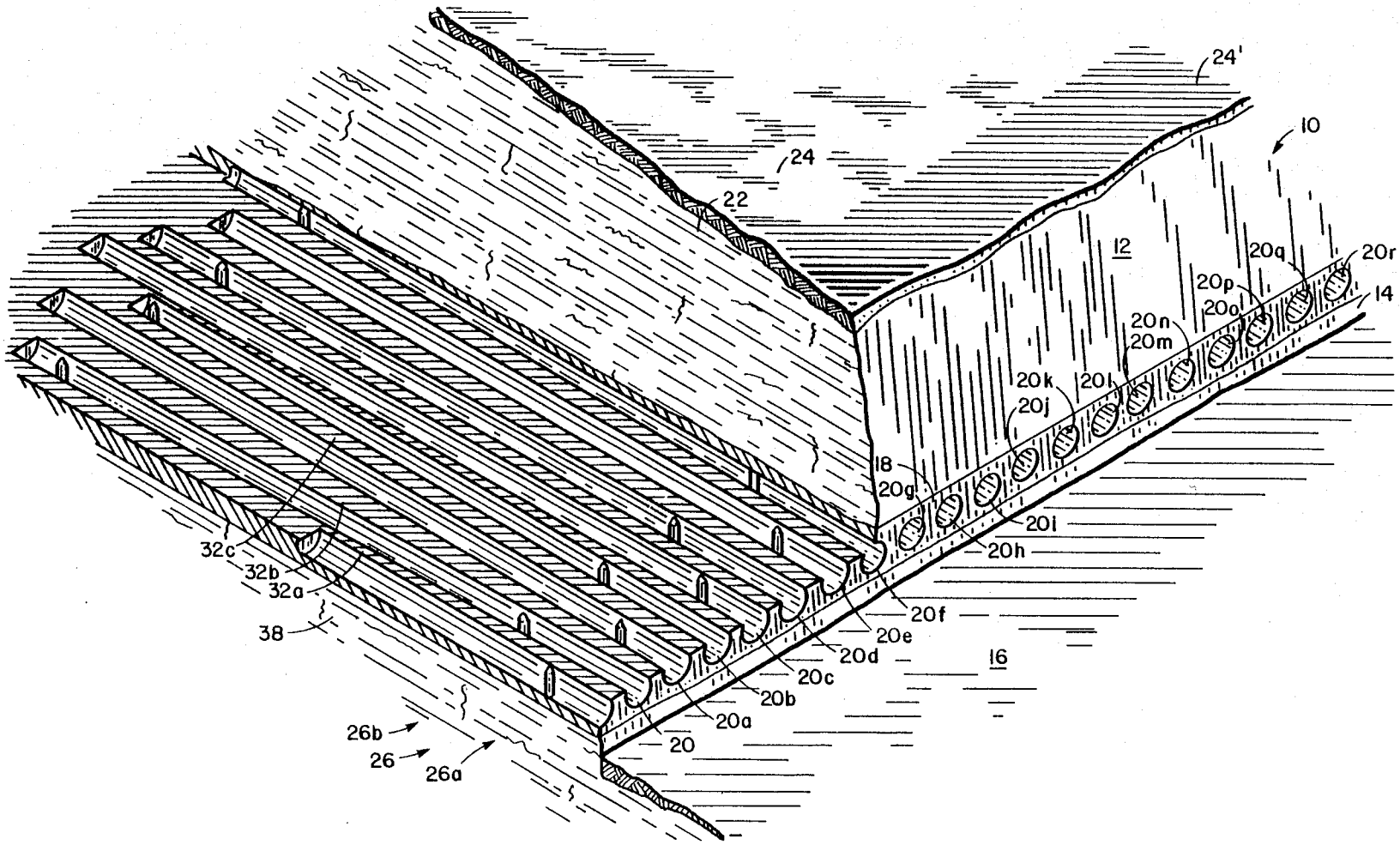
FIG. 1 is a perspective view of a highwall mining site having a portion of the overburden removed to more clearly illustrate the auger holes/cavities bored into a mineral seam such as coal.

In accordance with the illustrated embodiment of the invention, a method for reclaiming a highwall at a surface mining site is provided which is site specific and may vary to accomodate the various geological attributes of the mining site. The method is designed to produce spoil by the explosive reduction of highwalls to gradable rubble for highwall reclamation at mining sites having a large cavity or a plurality of holes/cavities bored into the coal vein commencing at the face of a highwall. The method includes the step of placing a series of non-directional charges at preselected locations on the floor of the cavity(s). The charges are packaged for placement but are otherwise unconfined. More specifically, one or more rows of unconfined charges are placed in a grid which covers the area, above which the overburden is to be turned into rubble by the brisance and pneumatic lift which results from the detonation of the charges. Upon initiation, the blast, following the course of least resistance, causes the lateral demolition of partitions or pillars between holes, if such exist, to the final vertical brisance and pneumatic lift which produce the desired vertical force vectors for creating rubble. More specifically, a simple air blast is generated by the deflagration of a charge. This air blast is momentarily confined by partitions in plural cavity reclamation sites or the sidewalls of a single cavity where only one cavity exists, retentive buffetting from the deflagration of surrounding charges, and stemming proximate the opening of the cavity(s) on the highwall. This confinement reduces the lateral intensity of the reaction causing fragmentative removal of the partitions, if such existed, thereby allowing lateral progression of the blast. The lateral dissipation of the blast is checked by the deflagration of other laterally positioned charges, which further confines the reaction. The explosive, laterally confined reaction acts upon the exposed undersurface of the overburden which is the upper wall of the cavity(s) in the ore seam and the cavity resulting from the pillar destruction. The resultant generated shock wave or force vector which produces fracturing of overburden, is principally vertical and coherent. Additionally, because of lateral removal of partitions a greater undersurface of the overburden is exposed to pressurized pneumatic lift from generated gases thereby enhancing fracturing. This fracturing is further enhanced by the transverse shearing action produced between laterally confined coplanar strata being sloppingly disoriented by pneumatic lift. Subsequent to fracture, the pneumatically lifted and impacted rubble and overburden falls back to earth further enhancing fracture. The rubble then sloughs into an incline, thereby further reducing the rubble size. In one embodiment, pressure retention is enhanced by stemming the area with avilable spoil. In another embodiment, employed when spoil for stemming is not available, stemming, in the form of rubble is created proximate the highwall by the detonation of a series of small, conventionally placed charges. Detonation of the conventional charges is performed within the principal detonation sequence, but occurs significantly before initiation of the main explosion. This time lapse permits collapse and deployment as stemming of the created rubble. Timing of the detonation sequence is performed by means of conventional M/S (millisecond) time delay fuses and by the use of primer cords with specific burning rates. An exemplary non-directional, water resistant, explosive packaged charge, suitable for use in cavities such as auger holes, is provided. In one embodiment, the charge employs an ammonium nitrate/fuel oil mixture, sometimes referred to as ANFO or Nitro-Carbo-Nitrates, as the principal blasting agent. The principal blasting agent, which is not cap sensitive and is not classified as high explosive, is preferably detonated by means of a high explosive booster which may be fired by either cap or detonating cord.

DESCRIPTION OF THE PREFERRED EMBODIMENT

Referring now to the drawings, a surface mining site with a highwall is generally indicated at 10 in FIG. 1. The mining site 10 includes a highwall 12 having a substantially upright and planar face which joins at its base 14, a substantially planar surface or bench 16 which is graded into the natural contour of the site. This planar surface 16 is the result of overburden and ore removal and serves to support mining equipment and mineral transport vehicles during the mining operation.

A mineral seam or vein such as coal is illustrated at 18. The illustrated seam has been augered or mined in some other manner leaving an undermining or faulted condition. More specifically, a plurality of elongated ore removal holes 20 are bored into the face of the coal seam. The holes 20 A–R are disposed substantially parallel but may slope from the horizontal plane to remain with the coal seam 18 and with respect to each other while extending into the coal seam 18. These holes are voids from which coal has been removed thus establishing the partially mined or faulted condition. Each of the ore removal holes includes one end portion opening on the face of the highwall and an opposite end portion disposed at a preselected depth within the seam, generally at the location of the coal seam "pinched off" or where the cutting tool which formed the hole began cutting material other than coal thereby contaminating the product. As shown in FIG. 1, the depth of the auger holes 20 A–R may vary from location to location. Additionally, the overburden depth may be 250 feet or more at one site and less than 10 feet at another site. Moreover, the overburden may consist of loose dirt at one site and solid rock at another site. In the site illustrated in FIG. 1, the overburden 22 is covered with foliage and top soil 24 and 24'' which may be removed from the above the direct blast site area 24' to prevent the foliage from prolonging settling time by being covered during the blast and subsequently losing volume and/or holding ability due to natural decay.

The reclamation process is accomplished by placing a series of explosive charges at predetermined locations proximate the openings of each of the holes. Each of the charges is directional and is positioned in a grid on the floor of the holes for directing and maximizing the explosive impact on the overburden at a preselected location above each of the charges such that rubble is created from the overburden above each of the charges. As shown in FIG. 1, the series of charges generally indicated at 26 are each placed on a selective ore removal hole floor at a spaced location from the respective hole openings. The illustrated series of charges are staggered and disposed in row **26*a* which is closest to the respective ore removal hole openings and row 26*b* which is disposed further within the holes forming a grid of explosives over the predetermined area required to create the desired amount of rubble. Normally, this first series of charges 26** is exploded simultaneously or at slight (9 millisecond, for example) delays and the explosive impact of the charges creates rubble from the overburden.

Figure 2:
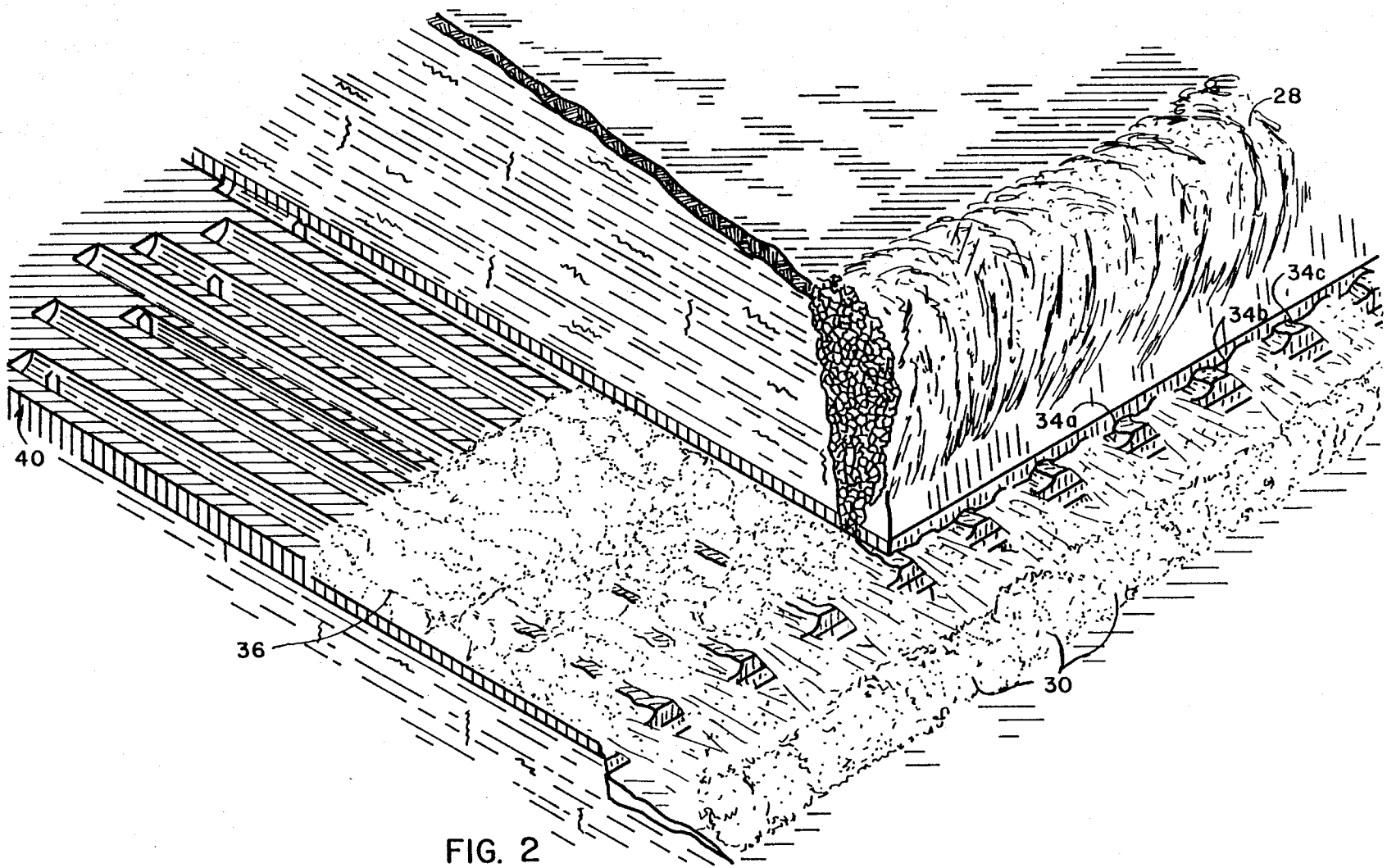
FIG. 2, is a perspective view of the mining site of FIG. 1 subsequent to partial reclamation by detonation of the directional charges, proximate the opening or forward end portion of the auger holes.

The effect of the explosion of the front end series of charges 26 is illustrated in FIG. 2. More specifically, as series of charges 26 is exploded rubble 28 is created proximate the face of the highwall as a result of the explosive impact on the overburden. The gases generated as a result of the explosion of the series of charges 26 partially exit the respective openings of the ore removal holes as air blast 30 and serve to tear out sections of the pillars 32 between the adjacent holes as the gases expand sideways. In the embodiment illustrated in FIG. 1, the staggering in grid configuration of the first series of charges serves to increase the impacted area and enhance the shearing forces which tear out the support pillars as illustrated at 34 and further increases the depth of the overburden destroyed proximate the face of the highwall. The rubble resulting from the detonation of the directional charges against the overburden and the shearing forces on the pillars is scattered about on the hole floors as indicated at 36 in FIG. 2. A portion of the expanding gases, side shock, and flying debris, which constitute the blast resulting from the explosion of the first series of charges, moves toward the rearward portion of each of the ore removal holes; inasmuch as the blast is confined by the underpinning or support strata on the underside and by the overburden on the top side.

It will be recognized by those skilled in the art that at mining sites where the overburden is loose or thin, the first series of charges will be adequate to create rubble proximate the face of the highwall, destroy the support pillars, and fracture the overburden at the rear of the holes allowing the overburden to collapse and thereby eliminate water impoundment areas.

In certain embodiments, for example, where the overburden reaches a thickness of 250 feet or more, the timed explosion of a further series of charges 40, which may be directional to enhance fracturing qualities, will provide a synergistic effect when combined with the expanding gases of first series of explosions to tear the support pillars out, create rubble at the openings of the holes and cause a collapse of the overburden sufficient to close the water impoundment areas. More specifically, in the illustrated embodiment the further series of directional charges is positioned in a grid pattern on the floors of each of the ore removal holes to maximize the explosive impact on the overburden above each of the charges. The explosion of the further series of directional charges is timed such that the blast generated encounters the blast generated from the explosion of the first series of directional charges.

Figure 3:
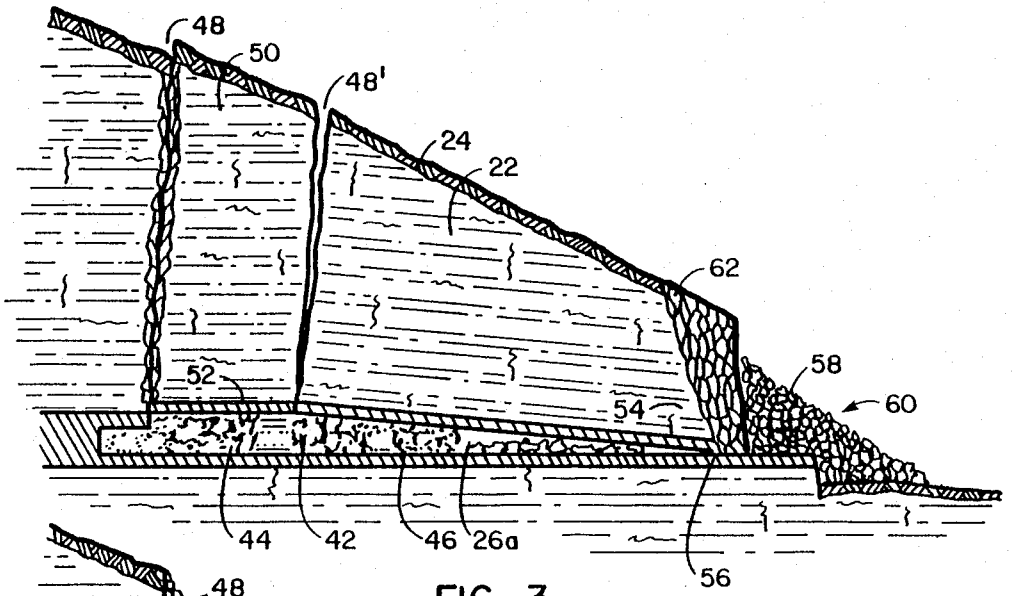
FIG. 3 is a sectional side elevation view of the mining site during the reclamation process and illustrating locations at which the overburden has been sheared.

As shown in FIG. 3, prior to the time the blast reaches the rear portion 42 of the hole 26*a*, the further series of charges is detonated at 44. This further explosion combines with the first explosion blast 46 to provide an enhanced lift vector or vectors on the roof of the ore removal hole proximate the second charges. This lift and any directed impact serves to create the fractures 48 and 48' in certain applications. The rearward portion 50 of the overburden is sheared at the fractures 48 and 48' and rises slightly at 52 causing the front end of the highwall proximate its face to fall as indicated at 54 inasmuch as the support pillars or sections thereof have been previously torn away. As this is occurring, the rubble 58 which had been created from the highwall by the initial blast, settles in a natural slope 60 blocking the holes to prevent escape of additional air blast and providing rubble which can be graded into a stable slope covering the highwall. As the forward portion 54 of the highwall strikes the underpinning or hole floor at 56, additional rubble 62 is fractured from the highwall, increasing the volume of rubble available for grading into a stable slope.

As was discussed more generally above, once the blast zones or expanding gases from the first and further series of charges encounter each other, they tend to confine each other and create lift vectors at 52. Moreover, the rubble 58 and the fallen overburden 22 resting on the underpinning at 56 tend to confine the expanding gases such that the air blasts 30 (see FIG. 2) are limited to the initial air blasts resulting from the explosion of charges 26, the blasts from charges 40 being confined. Inasmuch as the air blasts tend to be detrimental to the environment, it is important that these blasts are contained where feasible.

Figure 4:
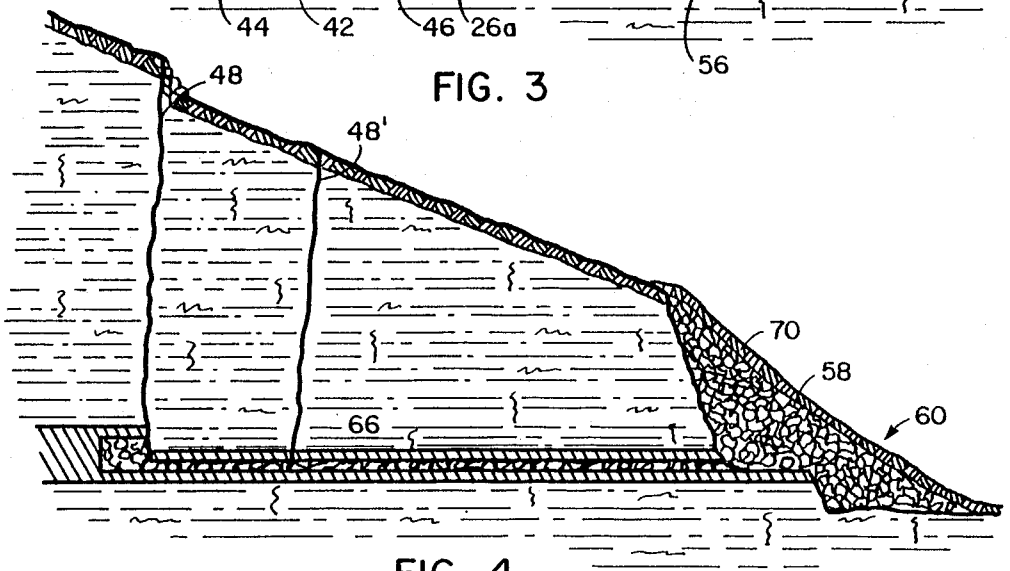
FIG. 4 is a sectional side elevation view of the mining site of FIG. 1 after the reclamation process has been completed.

Referring to FIG. 4, the overburden collapses subsequent to its fracturing at 48 and the destruction of the support pillars which are scattered about the ore removal hole floors as rubble 66. This collapsing of the overburden serves to eliminate the water impoundment areas. Moreover, the highwall can be effectively eliminated by the grading of the rubble 58 into a more clearly defined and stable ramp formation 60' subsequent to the collapse of the overburden. Soil 70 can be graded onto the ramp 60' to complete the reclamaton process, all without the necessity of digging "borrow" or "bar" pits on adjacent areas.

Figure 5:
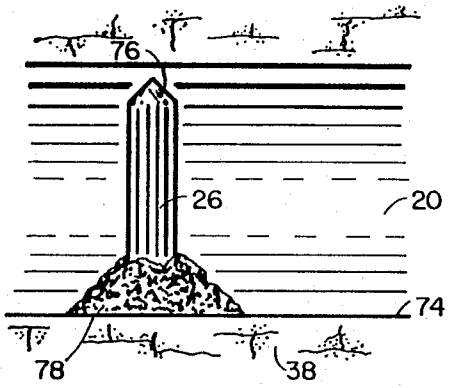
FIG. 5 is an elevation view of a typical directional charge used in the reclamation process.

Referring now to FIG. 5, details regarding a typical directional charge 26 will be explained. The directional charge 26 may be a shaped explosive or any other blasting media which directs its explosive impact in a predetermined direction. The illustrated charge 26 is shown in the ore removal hole 20 and positioned on the hole floor 74 which is the top surface of the underpinning or roofing 38. One suitable directional charge contains nitro-carbo-nitrate which is an oil impregnated ammonium nitrate base explosive. The explosive charge is generally mounted in a cylindrical shipping container with a 66% ammonia dynamite or equivalent charge placed on its end 76. As illustrated, the charge is positioned in a substantially upright position, as by propping it with sand or gravel 78. The primer (ammonia dynamite in one embodiment) on end 76 is exploded first by a detonating cord or electric cap. The primer in turn detonates the nitro carbo nitrate charge which is detonated by the primer 76 at the top to the floor 74 at a rate of 14,000 feet per second, releasing the major portion of the expanding gases upwardly in the preselected direction thereby maximizing the explosive impact on the overburden 22 at location 80. The initial shock or impact on the overburden at 80, demolishes the overburden by shock and creates rubble therefrom. At that point in time, the blast zone or expanding gases, flying rubble, and shock created move as described hereinabove.

An alternate step of the method of reclaiming a mining site comprises banking soil 82, rubble or the like as tamping, against the ore removal hole openings after placement of the charges in position in the auger holes. In this connection, the air blast 30 is reduced or eliminated by confining the expanding gases within the ore removal holes, and accordingly less explosive charge is required to tear out the pillars and allow the overburden to collapse.

Another alternate step of the method comprises drilling a blasting media placement hole 86 through the overburden 22 to a preselected depth such that the lower portion 88 of the hole is proximate an ore removal hole 20. A charge 26 is inserted into the hole 86 through the opening 90 at the upper surface of the overburden and positioned at the bottom of the blasting media placement hole near the ore removal hole. The hole 86 is then filled to direct the expanding gases through the portion of the overburden separating the bottom of the hole 86 and the ore removal hole 20. The expanding gases entering the ore removal hole 20 subsequent to detonation of the charge 26 in FIG. 6 then expand as described hereinabove to accomplish the destruction of the pillars.

Figure 8:
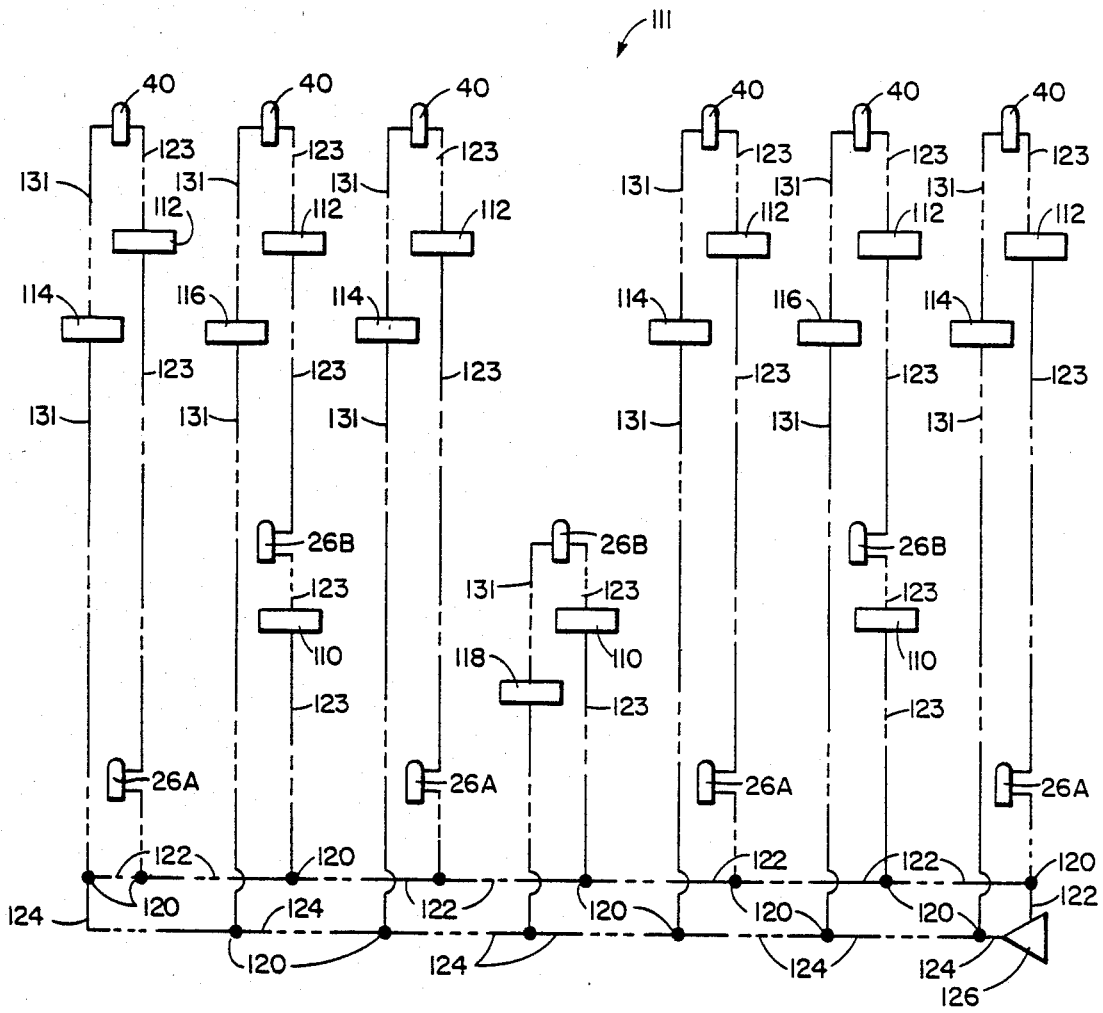
FIG. 8 is a diagramatic illustration of a detonation system for accomplishing the timed explosion of the directional charges.
Figure 9:
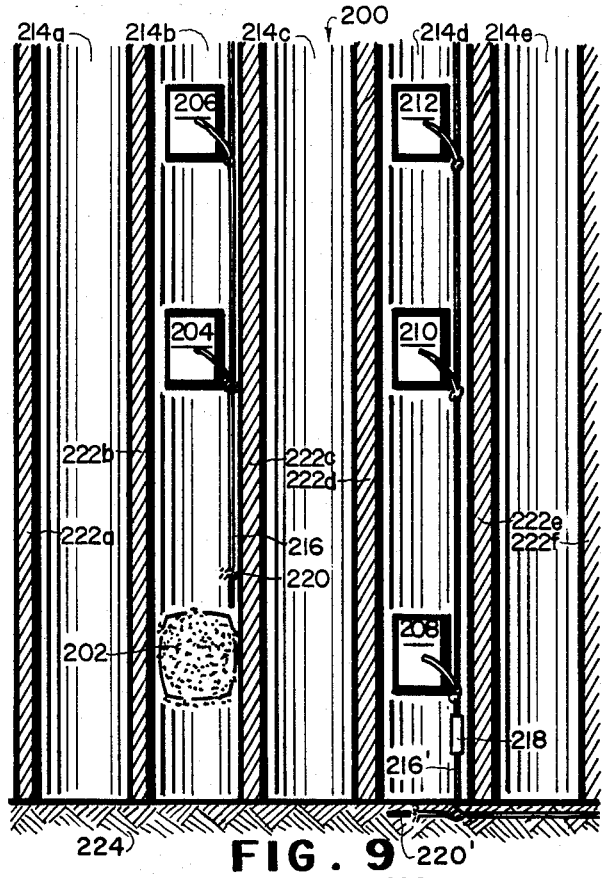
FIG. 9 is a plan view in section of a highwall mining site being reclaimed by sequential detonation of charges in accordance with various features of the present invention.

Referring now to FIG. 8, a detonation system is illustrated which serves to detonate the charges within the holes, and time the detonation in certain instances such that the charges explode at preselected times. The illustrated detonation system 111 includes an electrically ignited detonator 126, which is activated as by manual operation. This detonator 126 is connected through a primary detonation system 113 comprising the primary cord 122 and the branch cords 123 to the charges 26A–B and 40. In the illustrated embodiment typical connections between the primary cord and the branch cords are made at 120 in accordance with accepted practices in the industry. The primary detonation system 113 fires the charges 26A and 26B. In applications requiring delayed explosions, a delay fuse 110 which delays the explosion of the charge connected through the delay fuse to the detonator 126, is inserted in the branch lines between the charge and the detonator. In one embodiment, by delaying the explosion of the charges 26B by about 9 milliseconds later than the explosion of charges 26A, the side blast is enhanced for more complete destruction of the pillars while generating less vibration.

The primary detonation system 113 also fires the time delay fuses 112 interposed between the detonator and the charges 40. The time delay fuses 112 may be of a longer duration than the fuses 110, perhaps 25 milliseconds or more for example. Certain of the charges 40 are fired after a single delay determined by the fuses 112, while other charges may be fired after a series of delays as where fuses 110 and 112 are connected in series. The staggered detonation of charges 40 assures better breakage and develops less vibration.

The illustrated detonation system 111 includes a safety or back-up detonation system 124 which serves to remove by detonation any charges not exploded by the primary system to prevent unexploded charges from being left in the area. The safety system includes a safety line detonator cord 124 which is connected through a plurality of connectors 120 to the safety branch cords 131. The safety system ignites time delay fuses 114, 116 and 118 which can be of varying duration but which cause delays which are as long or longer than the total of the time delays within the line between charges 40 and/or 26*b* and the primary detonating cord 122. For example, if the delay of fuses 110 are 9 milliseconds each and the delays of fuses 112 are 25 milliseconds each, then the delays of: (1) fuses 114 would be 25 milliseconds, (2) fuses 116 would be 35 milliseconds and (3) fuses 118 would be 9 milliseconds.

Figure 7:
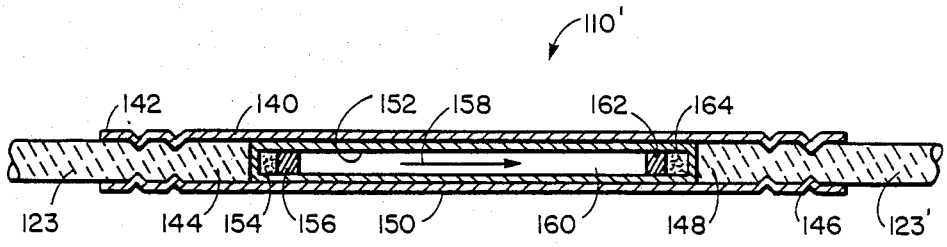
FIG. 7 is a sectional view of one example of time delay fuse used for timing certain of the explosions.

A typical delay fuse is illustrated in FIG. 7 and is indicated at 110'. This delay fuse serves to delay blasting or detonation of charges connected through it to the detonator. The illustrated delay fuse includes a substantially cylindrical housing 140 having one end portion 142 which is crimped about one end 144 of the branch cord 123'. The opposite end portion 146 of the housing is crimped about the end 148 of the branch cord 123'. The ends 144 and 146 of the detonating branch cord 123' are connected through a delay mechanism 150 such that the transmission of the detonation energy or impulse through the cord 123' can be delayed by a preselected interval. More specifically, the delay mechanism 150 is contained in the cylindrical housing 152 carried by housing 140 such that the opposite ends of the mechanism 150 about respective ends of the cord 123'. In operation, as the detonation energy reaches end 144 of cord 123, a charge 154 is ignited which throws the projectile in the direction of the arrow 158 through the housing passage 160 of a preselected length, thereby causing a delay in the transmission of the detonation energy or impulse. As the projectile 156 strikes the detonator 162, the charge 164 is ignited thereby introducing the detonation impulse back into the cord at its end portion 148. The delay of the detonation impulse transmission through the mechanism 150 can be controlled for timing the detonation of the charges within the holes. One suitable delay connector for use on explosive primer detonator cord is the MS-9 manufactured by the Austin Powder Company, 3735 Green Road, Cleveland, Ohio 44122.

In a further embodiment, a blasting method is provided which is suitable for use with non-directional explosive charges. Unlike conventional coyote blasting which employs nitroglycerine based high explosives tightly loaded into a confined and stemmed void such as a sealed cave or hole, the method employs oxidizers or low explosive principal charges. Further, while the total blast is confined by stemming to maximize pneumatic lift, the individual charges are unconfined in a convention sense. Therefore, the attributable burning rates of the charges commence at the decelerated "unconfined rate" which is generally 50% to 75% of the confined rate.

An exemplary placement and detonation sequence is generally indicated at 200 in FIGS. 9, 10, 11, and 12. More specifically, a series of explosive charges 202, 204, 206, 208, 210 and 212 are positioned at preselected locations, as on a grid in auger holes or cavities. The charges can be placed in adjacent cavities or in every other cavity as illustrated.

Figure 10:
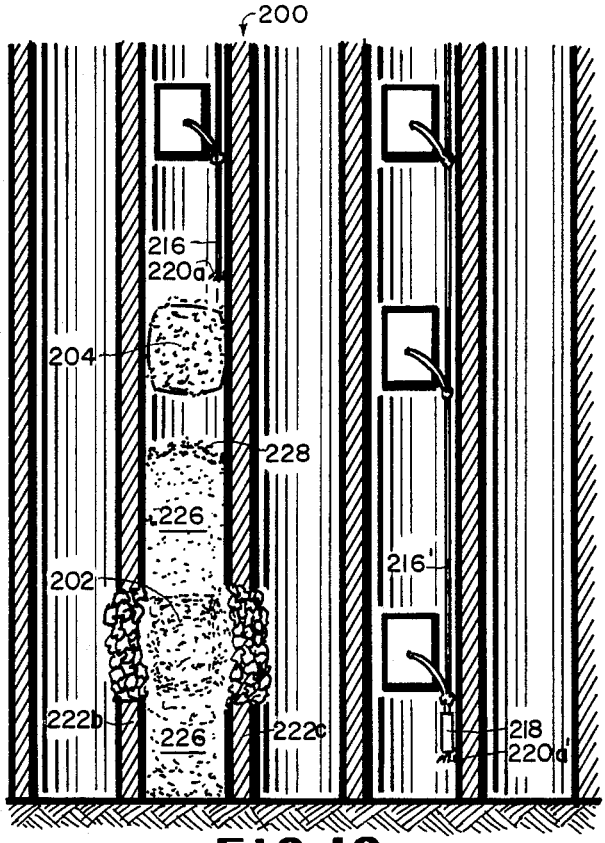
FIGS. 10–12 are plan views in section of the progression of the detonation sequence of FIG. 9.
Figure 11:
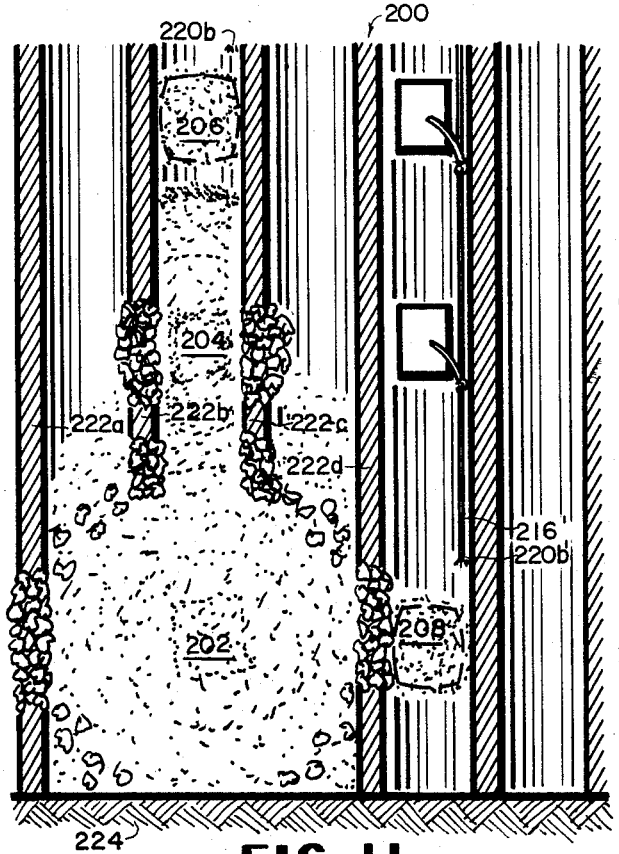
Figure 12:
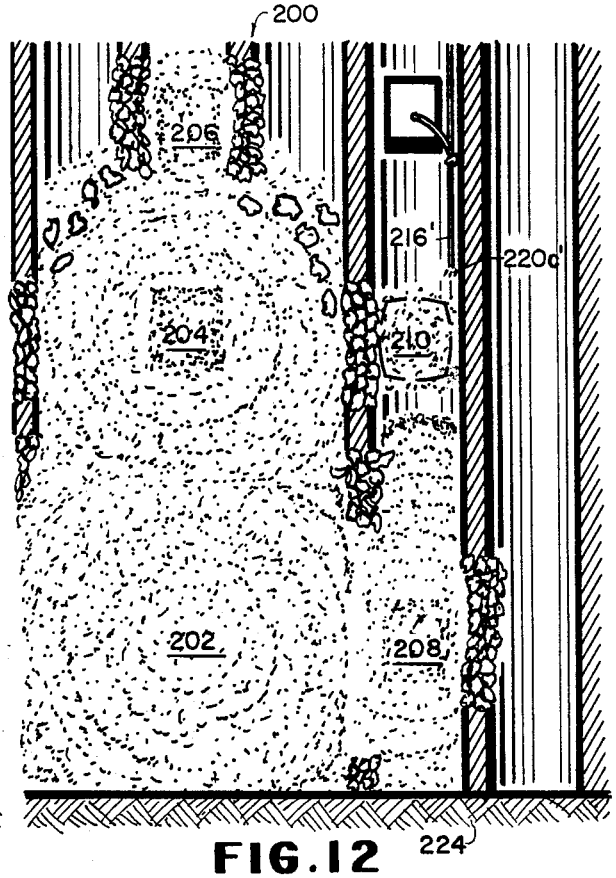

Each of the charges is attached to a system of detonating cord 216 and 216' which, in the firing sequence depicted in FIGS. 9, 10, 11, and 12 has burned to points 220 and 220' illustrated in the figures. Included in the detonation cord network is the time delay fuse 218 which delays the detonation by a preselected number of milliseconds. More specifically, as illustrated in the drawings, the detonating fuse 216 and 216' in FIG. 9, has burned to point 220, and detonated the charge 202. As the unconfined explosive charge 202 FIG. 10 deflagrates it sends out a wave of hot burning gases 226 and unburned explosives which are carried in front of the expanding air blast. As pressure increases proximate the deflagrating charge 202, the partitions 222*b* and 222*c*, adjacent to the explosion, fracture and give way. Simultaneously the fuse 216, which has a significantly faster velocity of detonation than the charges, detonates to point 220*a* (FIG. 10). This detonates charge 204 before charge 204 can be physically moved by the expanding gases emanating from the deflagration of charge 202. Further, in an additional simultaneous action, fuse 216' burns to point 220*a'* (FIG. 10) detonating time delay 218 which temporarily delays further detonation. As the detonating sequence continues, the charge 202 (FIG. 11) propels unburned powder previously indicated at 228 in FIG. 10 into the deflagrating charge 204 where it is burned. Further, the expanding gases of the deflagrating charge 204 act as a confinement for the blast from charge 202 thereby increasing pressure and the velocity of detonation. Additionally, charge 204 contributes to the intensity of the blast of 202 with the insemination of unburned powder from charge 202. The charge 202, which can be further confined with stemming 224, continues to expand laterally fracturing partitions 222*a* and 222*d* and continuing to destroy partitions 222*b* and 222*c*. Simultaneously, the fuse 216 has detonated to point 220*b* (FIG. 11) and detonates charge 206. Additionally fuse 216' has detonated to point 220*b'* (FIG. 11) and detonated charge 208. As is seen in FIG. 12, as the fuse 216' continues to point 220*c'* , the deflagrating charges 202, 204, 206, 208 and 210 remove all partitions and confine each other thereby increasing the reaction pressure and the velocity of detonation. As gas pressure and reaction velocity increase, pneumatic lift and coherent vertical brisance occur.

Figure 13:
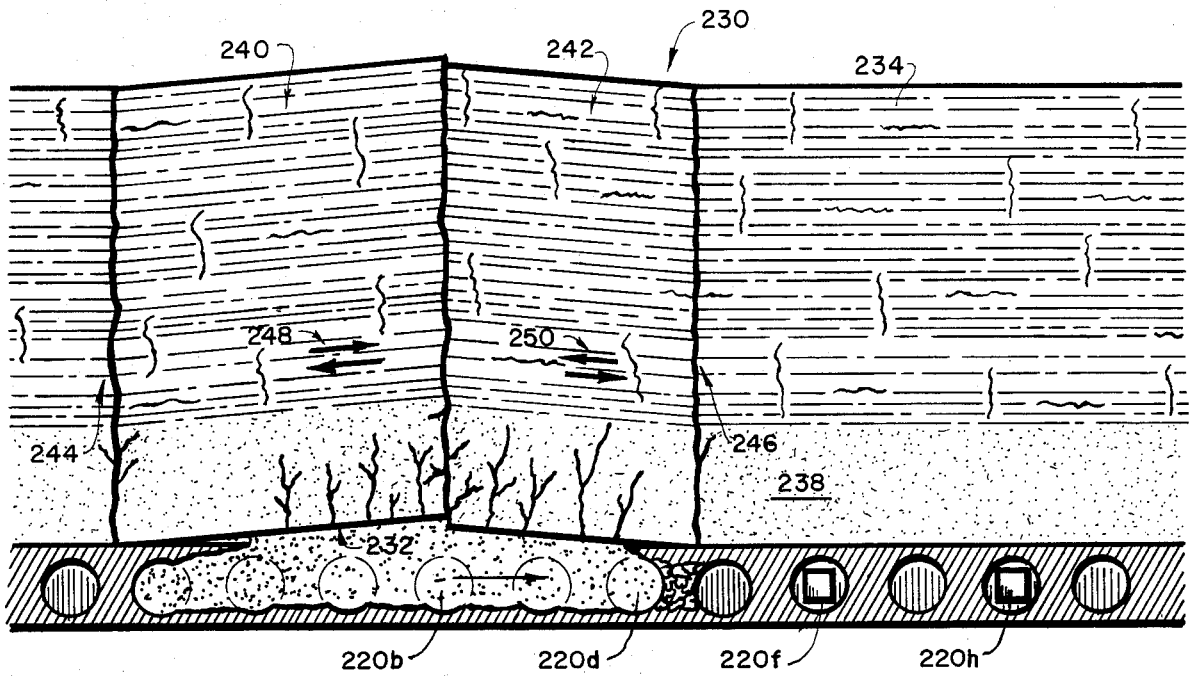
FIG. 13 is a elevational view in section of a highwall mining site being reclaimed by sequential detonation of charges in accordance with various features of the present invention.

The exemplary sequence depicted in FIGS. 9, 10, 11 and 12 can be a part of a larger firing sequence indicated generally at 230 in FIG. 13, wherein the initial point of detonation, hole 220*b*, has exerted coherent vertical brisance and pneumatic lift on the under surface 232 of the overburden 234, causing heaving and fracturing. Fracturing is therefore the synergistic resultant of dual causation, namely the forces created by the expanding gases and the brisance forces.

Brisance is the shattering power of high explosives. Detonation and defagration of a charge sets up in rock a compressive strain pulse which travels from the charge hole and attenuates to zero, unless and until it reaches a free face, in which case it is reflected as a tensile strain pulse. The rock is therefore broken in tension, aided and displaced by the high gas pressure. Brisance is most effective in breaking hard, brittle, elastic rocks. When plastic rock material such as stiff clay, mud stone, soft shale and permafrost are blasted, they tend to absorb and dissapate the shock wave. Further, bedding planes, joint planes, and planes of weakness tend to act as partial reflectors of brisance. These cause a portion of the energy to be reflected while the other portion of energy is transmitted. The respective percentages are contingent on joint strength.

Brisance, like most energy forms, tends to travel in all directions equally and dissipate at a rate equal to the square of the distance traveled. Present formulation for brisance transmittal, typical of which is the formula postulated by O. Andersen which states:

$$B = c\sqrt{DL}$$

where

B=Burden Distance, ft.

D=Hole Diameter, ft.

L=Length of Hole, ft.

c=Constant Determined Empirically are based upon the concept of a symmetrical point or line source (borehole) radiating equally in all directions. These formulas are therefore of no use in determining the effects of the present method, which directs the brisance. This direction of brisance is more aptly likened to the effects of a directional radio antenna which increases amplitude and range within a specific area.

In conventional blasting, the explosive material derives its disrupting force, when confined in a borehole in a rock mass, mainly from the effects of brisance which is strain energy, creating radial cracking into the rock, and from "bubble energy" representing the high pressure gases thereby expanding these cracks to the point of brittle fracture. In such cases, these hot gases occupy many times the original volume and thereby exert high pressure on the surrounding rocks.

In the present invention, the energy of the expanding gases, which produces bubble energy in conventional blasting, is directed against the large, more or less horizontal, planar surface which is the exposed underside of the overburden. In the case of a single cavity, such as at a longwall mining site, this exposed underside or surface of the overburden comprises the upper wall of the cavity. In the case of a plurality of substantially parallel cavities, such as auger holes, the exposed underside or surface of the overburden comprises the upper wall of the holes and the adjacent portions of the overburden exposed by the removal of the pillars between the cavities.

Figure 14:
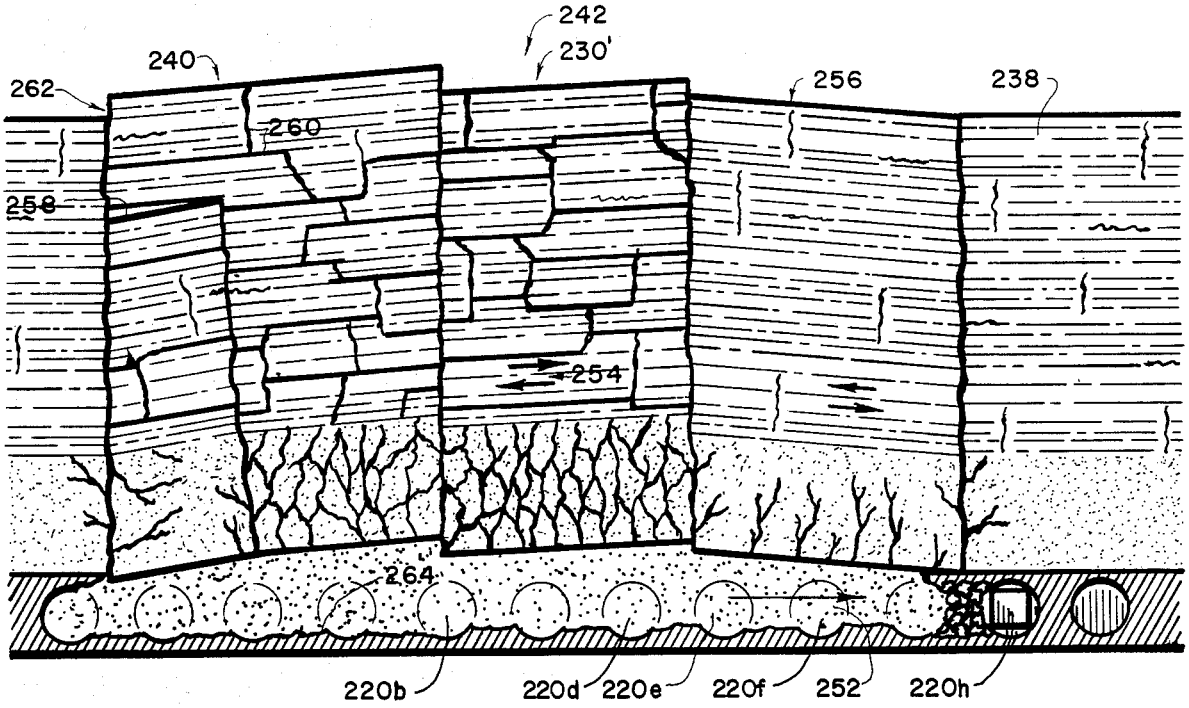
FIG. 14 is an elevational view in section of the progression of charge, the charge detonation sequence of FIG. 13.
Figure 15:
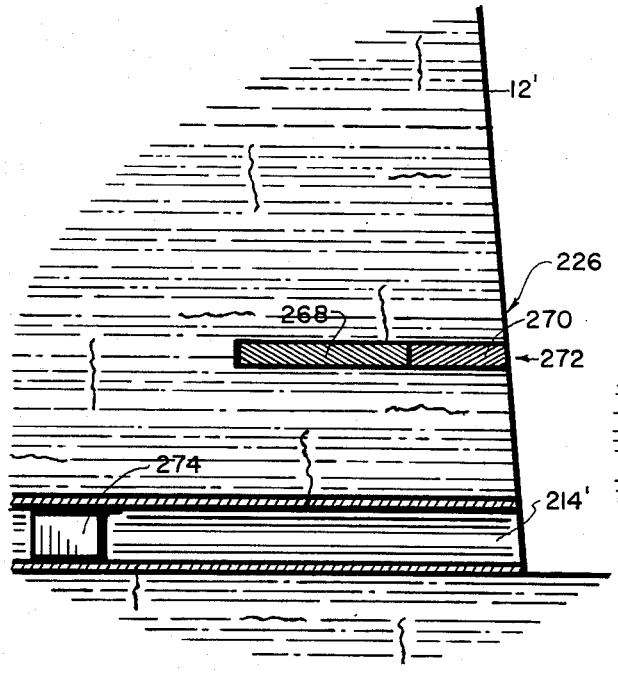
FIG. 15 is an elevational view in section showing the placement of a horizontal and/or vertical type charge to create stemming.

Gas pressures generated by blasting do not have to reach levels which produce intrusions into fractures and bedding planes. Instead, pneumatic lift commences as soon as the overburden load is overcome. This therefore reduces the amount of powder and stemming that would be required to produce a similar effect with borehole placed charges. As pneumatic lift occurs the overburden, which is generally composed of layers of various sedimentary materials including intermediate layers of plastic rock material such as stiff clay mudstone, soft shale and the like are vertically fractured by heaving. The disoriented sedimentary layers 240 and 242, (See FIG. 13) which are laterally confined by the overburden 238 at 244 and 240, are subjected to transverse shear loads between adjacent strata indicated by the force indicating arrows 248 and 250. This transverse loading is transmitted directly into horizontal and vertical fracturing of the overburden, usually along bedding planes, joints, and planes of weakness. As the larger sequence, generally indicated at 230' in FIG. 14, progresses along the direction of the firing sequence 252, fracturing due to brisance, pneumatic lift, and transverse loading continue in zones 240 and 242. Zone 242 can experience additional fracturing due to reversed transverse loads expressed at 254 which may be the result of orientative shifts in the overburden as the explosive epicenter moves in the direction of the firing sequence to the demolished auger holes 220*d* and 220*f*. As the firing progresses, additional segments of overburden 256 are dislodged and fractured. As pneumatic lift dissipates, the overburden, which has heaved at 258, cracked at 260 and volumetrically expanded at 262, falls fracturingly upon the cavity floor or lowerwall 264. It then sloughs as indicated at 60 in FIG. 3 and 60' in FIG. 4. The rubble may then be graded and covered with soil 70 suitable for vegetation.

Figure 6:
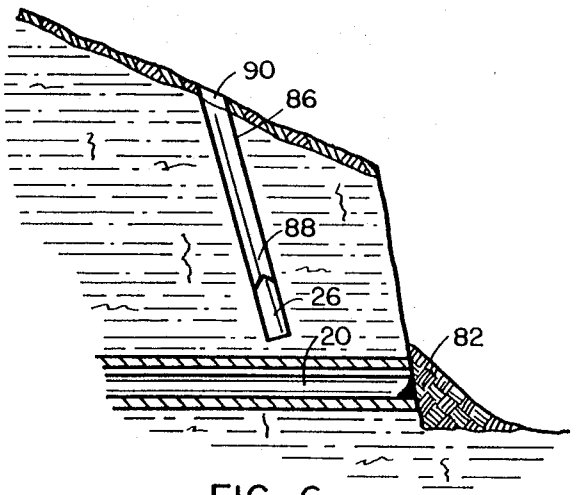
FIG. 6 illustrates alternate steps in the method of reclaiming a highwall.
Figure 16:
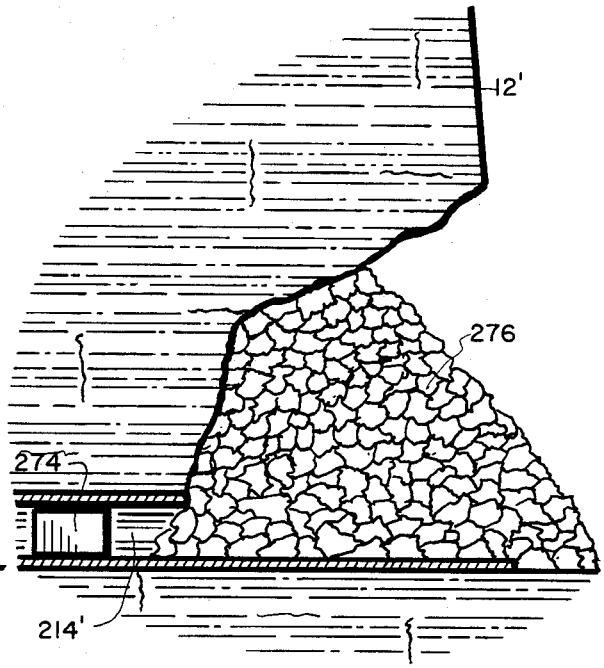
FIG. 16 is an elevation view in section depicting stemming created by a horizontal and/or vertical charge.

To minimize air blast subsequent to detonation and to enhance pneumatic lift, the entry(s) or openings(s) to the blast area are plugged or stemmed at 82 in FIG. 6 with available spoil. If suitable spoil for stemming is not available, it may be created from the highwall by the prior detonation of a series of small conventionally placed presplitting charges proximate the cavities' entry. Placement of presplitting charges can be in vertically drilled holes as depicted at 86 in FIG. 6 or horizontally drilled highwall type charges generally indicated at 266 in FIG. 16 which are tightly packed horizontally deployed explosive charges 268 confined with stemming 270, which charges completely fill a horizontally bored hole or cavity 262 thereby increasing the velocity of detonation (VOD) by compaction. The presplitting charges, whether vertically or horizontally placed, are located conveniently above and horizontally between the highwall 12' and the non-directional charges 274. Upon detonation, rubble 270 FIG. 16 is created in place thereby stemming the auguer hole 214'.

Figure 17:
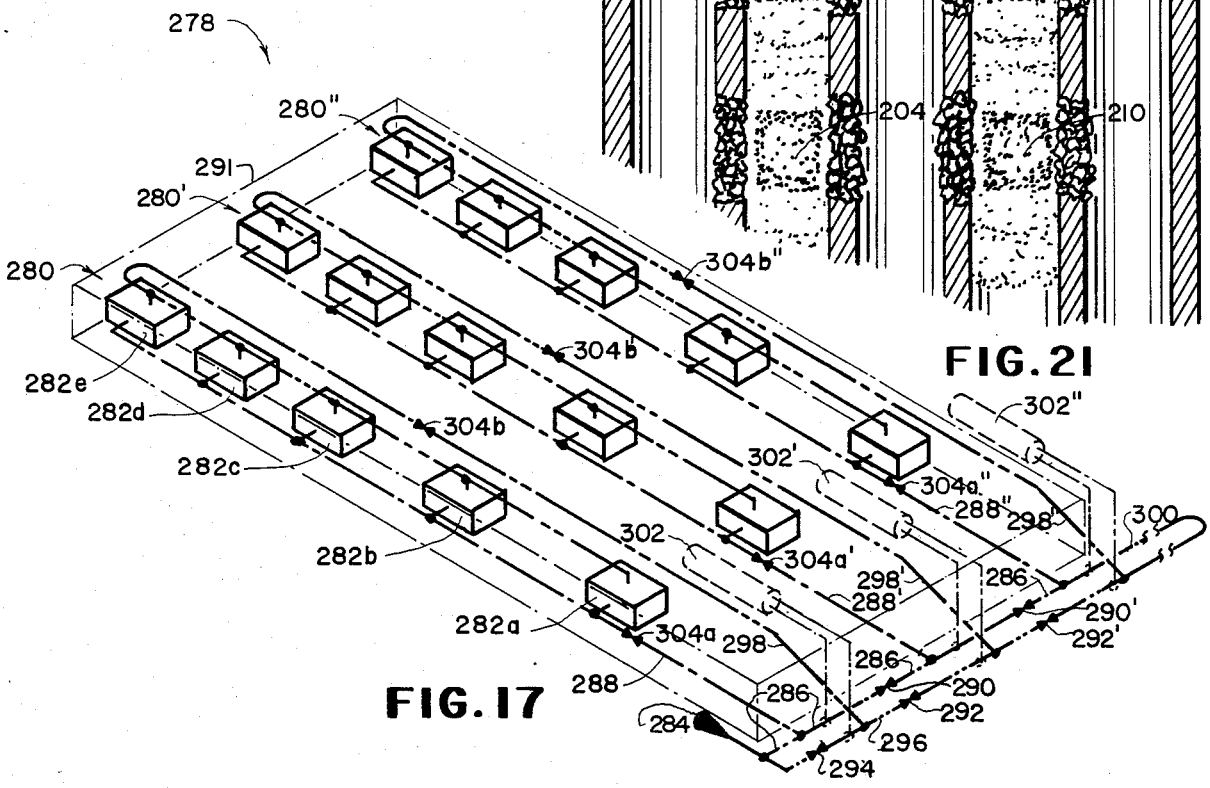
FIG. 17 is a diagramatic illustration of a detonation system for accomplishing the timed explosion of non-directional charges.

A diagramatic illustration of a detonating system suitable for use with non-directional charges is provided at 278 in FIG. 17. More specifically, a plurality of similar charge series 280, 280', 280'', each of which is composed of individual charge units 282*a*, 282*b*, 282*c*, 282*d* and 282*e* are specifically located to form a blasting grid. If the charges are of similar size, the grid spacing between charges may be altered in an inverse proportion to the highwall height. This thereby provides increased pneumatically pressurized lift for increases overburden weight. Similarly, if spacing is maintained constant, the charge size may be varied to provide such lift. In the preferred embodiment, a detonating cap 284 fires the primary detonating line 286, which fires primary trunk lines 288, 288' and 288". As the exemplary trunk line 288 detonates, the charges 282*a*, 282*b*, 282*c*, 282*d*, and 282*e* are sequentially fired due to the time lag inherent in detonating the primer cord. If the charge series 280, 280' and 280" are located in auger holes or the like, the blast retardation, inherent in the distruction of the pillars or partitions, serves to decrease seismic impact by the introduction of the M/S delay fuses 290 and 290' placed between the series 280 and 280' and 280". The M/S time delay fuses approximate the minimum breakthrough time for the partitions thereby introducing delays from hole sequence to hole sequence minimizing seismic peaks. In open zones or single cavity applications as shown at 291 in FIG. 17 such as long wall mines or in flooded areas, blast retardation due to barrier destruction does not exist, therefore, delays 290, 290', 292 and 292' would not be used.

A secondary, time delayed safety fuse is also provided for the detonation of unfired charges which may exist due to fuse malfunction. The safety line, which is connected to the detonating cap 284 by means for a M/S time delay fuse 294, consists of a main detonating line 296 and a series of trunk lines 298, 298' and 298". The main line is also connected to the primary line 286 at a point 300 in the firing sequence. Time delays 292 and 292' are introduced into the main line to match delays 290 and 290' thereby preventing preliminary firing of charges by the safety line.

In an alternate embodiment, which embodiment employs preliminary detonated presplitting charges 302, 302' and 302", the charges are connected by means of a primer cord to the primary detonation line 286 and the main safety detonation line 296. To insure presplitting of rubble for stemming prior to detonation of the main charge sequence, a series of M/S time delays 304*a*, 304*b*, 304*a'*, 304*b'*, and 304*a"* and 304*b'* are introduced into both the primary trunk lines 288, 288' and 288" and the safety trunk lines 298, 298' and 298". These M/S time delays, which can be as great as 300 milliseconds, are physically located inside the hole from the presplitting charges 302, 302' and 302" thereby preventing accidental disconnection of the primer cord by the presplitting charges.

It will be recognized by those skilled in the art that while the exemplary schematic diagram depicts three rows of charges each of which contains five individual charges with and without presplitting charges many variations of this arrangement are possible, including more or fewer series and more or fewer individual charges. It is the intent of this patent to include all such variations within its scope.

Figure 21:
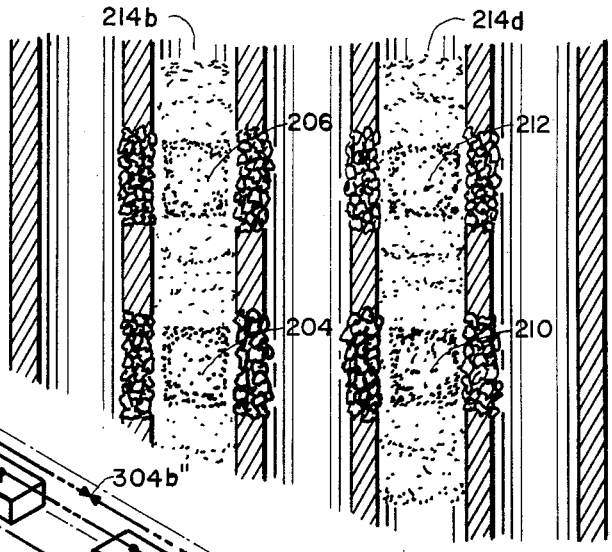
FIG. 21 illustrates a reclamation process in which each of the charges are exploded simultaneously.

FIG. 21 illustrates a method for reclaiming a highwall at a surface mining site having at least one cavity extending into the face of the highwall. In the embodiment illustrated in FIG. 21, the charges are detonated simultaneously to produce the bubble energy and brisance for the election of forces sufficient to accomplish the reclamation process. It will be noted that in the simultaneous detonation of the charges, the charges tend to confine each other such that the horizontal seismic forces are attenuated. Also, the simultaneous detonation of the charges generate a sufficient vertical vector to produce the lifting forces necessary to move the overburden and accomplish the reclamation in manners substantially identical to the process illustrated in FIG. 13–14.

Figure 18:
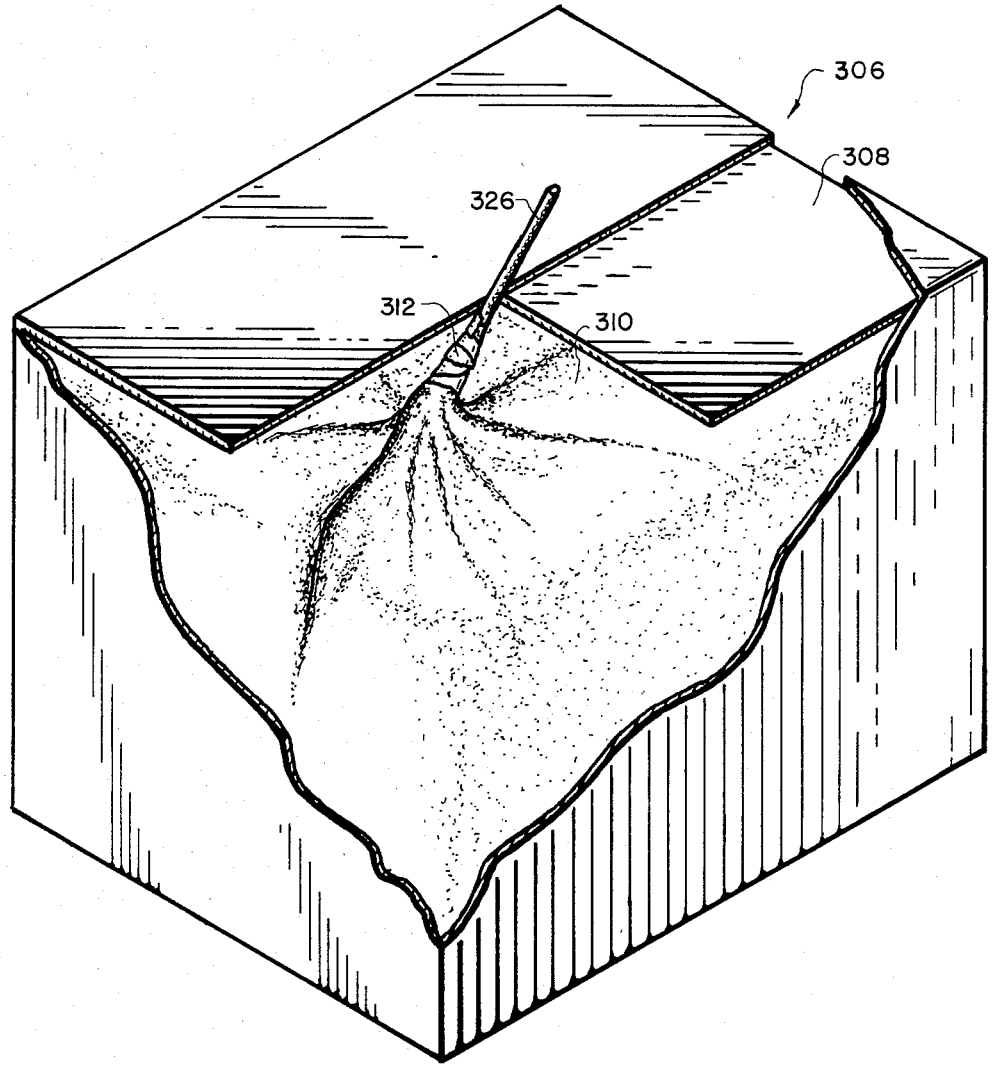
FIG. 18 is an isometric view partially in section of an exemplary explosive charge.
Figure 19:
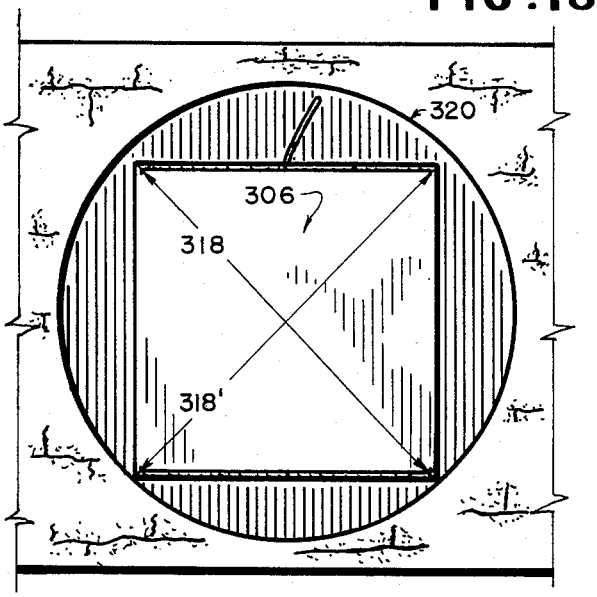
FIG. 19 is an elevation view of the charge depicted in FIG. 18 disposed in a cavity created by mining.
Figure 20:
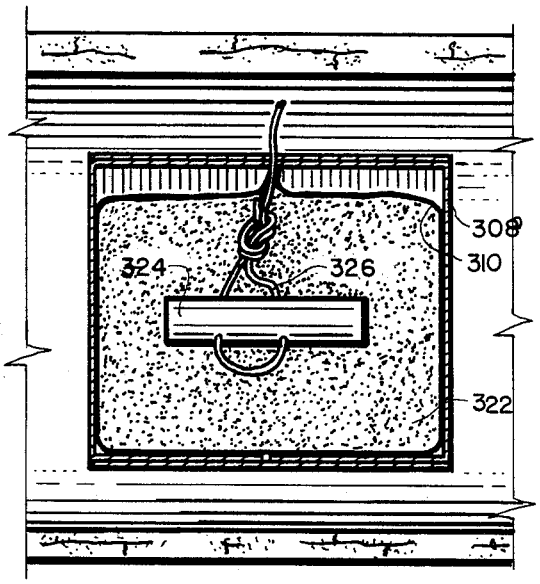
FIG. 20 is an elevation view in section of the charge depicted in FIGS. 18–19 disposed in a cavity.

An exemplary charge suitable for use in auger holes is generally indicated at 306 in FIG. 18. The charge which is easily field assemblable, is loaded into a corrugated box containing a water impervious liner 310 which can be a plastic bag. Box sizing is critical in small cavity applications since its maximum diagonal dimension 318 and 318' FIG. 19 should be just smaller than the exemplary auger hole or cavity 320. The corrugated box 308 FIG. 20 with the liner 310 is partially filled with one half of the blasting or explosive agents 322 to be used. A booster charge 324, armed with primer cord 326, is placed upon the loaded blasting agent 322. The remaining blasting agent is then loaded on top of the booster charge thereby enhancing ignition of the blasting agent and accelerating the velocity of detonation. In an exemplary embodiment, the primary blasting agent is 100 pounds of AN/FO which requires protection from water. The booster charge is a single 2"×8" stick of 60% nitroglycerine dynamite. The outside dimensions of the corrugated box are 16"×16"×18" and contains 2.66 cubic feet. Orientation of the booster is important. After loading of the charge into the auger hole, the longitudinal axis of the booster should be roughly parallel to the longitudinal axis of the auger hole thereby minimizing the downhole loss of unburned, unexploded blasting agent 322. After filling, the waterproof liner 310 is drawn tightly about the protrusion of primer cord 326 and a water resistant seal is affected by wrapping the joint with a pliable adhesive strip 312 which can be electricians tape. The box 308 is then sealed. The corrugated box provides scuff protection for the charge during loading and solid support when loaded.

From the foregoing detailed description, it will be recognized that an improved method and apparatus for reclaiming a highwall mining site has been described and illustrated. More specifically, the method of the present invention includes the placement of the plurality of charges at preselected locations within either a single cavity 291 (See FIG. 17) such as produced in longwall mining operations or in a plurality of cavities such as produced while boring auger holes. The charges are detonated either sequentially or simultaneously to produce the bubble energy from the expanding gases and the brisance necessary to accomplish the reclamation process. Preferably, the charges are unconfined and nondirectional and in one embodiment the charges are contained in a waterproof container such that flooded areas can readily be reclaimed by ulitilization of the present invention. In order to maintain the blast pressure within an associated cavity during blasting and to attenuate a blast mission, the cavities are preferably sealed through stemming prior to detonation of the charges disposed within the cavity itself. The stemming may be accomplished with presplitting charges positioned proximate the openings of the cavities onto the highwall face. It has been found that in both a simultaneously and sequential detonation operations, the charges tend to attenuate the horizontal force vectors thereby reducing seismic shock. Thus, the charges tend to contain each other and synergistically act to produce a pneumatic lift vector in a verticle direction to assure proper breakage of the overburden, which is an essential step to proper reclamation.

While a preferred embodiment has been shown and described, it will be understood that there is no intent to limit the invention by such disclosure, but rather it is intended to cover all modifications and alternate constructions falling within the spirit and scope of the invention as defined in the appended claims.

What is claimed is:

1. A method for reclaiming a highwall at a surface mining site having at least one cavity extending into the face of the highwall, said cavity extending substantially horizontally into a preselected mineral deposit or seam of ore, such seam being disposed below overburden and above underpinning, said method comprising the steps of:

placing a plurality of charges at preselected locations within said cavity, and detonating each of said charges within said cavity thereby creating rubble from said highwall, overburden and underpinning.

2. A method for reclaiming a highwall at a surface mining site having a plurality of cavities extending into the face of the highwall, said cavities being exposed substantially parallel with respect to each other and extending into a preselected mineral deposit or seam of ore and opening on the face of the highwall, such seam being disposed below overburden and above underpinning and separated by pillars of hard mineral deposits, said method comprising the steps of:

placing a plurality of charges at preseleted locations within preselected cavities, and detonating each of said charges within said cavities thereby creating rubble from said highwall, overburden, underpinning, and pillars.

3. The method of claims 1 or 2 wherein each of said charges is an unconfined and non-directional charge and wherein each of said charges is explosively joined by detonation means.

4. The method of claim 3 wherein each charges are detonated sequentially within said cavity.

5. The method of claim 3 wherein each of said charges are detonated simultaneously.

6. The method for reclaiming a highwall at a surface mining site of claims 1 or 2 wherein each cavity is sealed proximate the highwall with stemming to maintain pressure within the associated cavity during the blast and to attenuate air blast emission including pressurized gases, flying debris, and noise from the cavities.

7. The method of claims 1 or 2 wherein said charges are detonated such that the horizontal blast creates force vectors of the various charges which counteract and whereby a pneumatic lift vector is generated and acts on the overburden to cause breakage and create gradable rubble for reclamation purposes.

8. The method for reclaiming highwall at a surface mining site of claim 2 wherein the detonation of the charges produces air blasts within the cavities and lateral breakage of the pillars in situ between the cavities thereby producing a resultant cavity having an upper wall with a greater surface area than the side walls of such resultant cavity which are the remaining pillars between the cavities, and the rear wall of the cavity.

9. The methods of claims 1 or 2 wherein detonation of said charges produces a seismic shock pulse of brisance which has a greater vertical intensity and an attenuated horizontal intensity to produce an increase in the overburden breakage while reducing undesirable laterally directed seismic shock waves.

10. The method of claim 9 wherein the charges within each cavity are detonated simultaneously thereby attentuating the intensity of the seismic shock pulses of brisance in the horizontal direction.

11. The method of claim 10 wherein the charges are detonated sequentially.

12. A method for reclaiming a highwall at a surface mining site having at least one cavity extending into the face of said highwall, said cavity extending substantially horizontally into a preselected mineral deposit or seam of ore, said seam being disposed below overburden and above underpinning, said method comprising the steps of:

placing a plurality of charges at preselected locations within said cavity;

sealing said cavity with stemming produced by explosively presplitting a portion of said highwall proximate an opening to said cavity thereby eliminating the need for extraneous material for use as stemming; and detonating each of said charges within said cavity thereby creating rubble from said highwall, overburden and underpinning.

13. The method of claim 12 wherein presplitting charges are placed within substantially vertical holes proximate said cavity opening.

14. The method of claim 12 wherein presplitting charges are placed within substantially horizontal holes vertically above and proximate said cavity opening.

15. The method of claim 13 wherein presplitting charges for the production of stemming are positioned proximate the opening of each cavity and are detonated prior to the detonation of said charges disposed within said cavity.

* * * * *